United States Patent [19]

Bunch, Jr.

[11] Patent Number: 4,493,688

[45] Date of Patent: Jan. 15, 1985

[54] PAPER ROLL FEED RACK FOR PROCESSING MACHINE

[76] Inventor: Earnest B. Bunch, Jr., 9619 N. 21st Dr., Phoenix, Ariz. 85021

[21] Appl. No.: 428,937

[22] Filed: Sep. 30, 1982

[51] Int. Cl.[3] ..... B65H 45/00

[52] U.S. Cl. ..... 493/413; 493/399

[58] Field of Search ..... 493/413, 414, 415, 437, 493/419, 423, 399; 270/30, 31, 39

[56] References Cited

U.S. PATENT DOCUMENTS

| | | | |
|---|---|---|---|
| 2,098,427 | 11/1937 | Menschner | 493/413 |
| 3,086,768 | 4/1963 | Lach | 493/415 |
| 3,352,553 | 11/1967 | Preston | 493/413 |
| 3,711,085 | 1/1973 | Bunch | 493/413 |
| 4,030,720 | 6/1977 | Jones | 493/413 |
| 4,097,039 | 6/1978 | Fischer | 493/413 |

*Primary Examiner*—Leon Gilden

*Attorney, Agent, or Firm*—Drummond & Nissle

[57] ABSTRACT

Improved apparatus for producing continuous form stationery by creasing a strip of paper along lines of weakening formed therein. The apparatus includes a frame, a distributing mechanism mounted on the frame for alternately distributing successive lines of weakening in the paper in substantially opposite directions, dispensing rollers mounted on the frame for drawing the paper from a supply thereof and dispensing the paper into the distributing mechanism, mechanisms carried by the frame for urging the distributed paper into a creased condition, and a conveyor for receiving and transporting the creased paper. The improvement consists of a system for removably securing the paper supply in position to dispense paper during the operation of the paper processing apparatus. The improved paper securing system includes a carriage movably carried by the frame and moved between two operative positions by a linkage assembly.

1 Claim, 4 Drawing Figures

PAPER ROLL FEED RACK FOR PROCESSING MACHINE

This invention relates to paper processing apparatus.

More particularly, the invention relates to an improved paper roll feed rack for delivering paper into a paper processing machine during the operation thereof.

Even more specifically, the invention concerns an improved paper roll feed rack for a paper processing machine of the type having a mechanism which distributes successive lines of weakening formed in a strip of paper in substantially opposite directions, and having additional mechanisms for creasing the paper along the lines of weakening to produce continuous form stationery.

In a further aspect, the invention concerns an improved paper roll feed rack which is particularly useful in a wide variety of paper processing machines such as collating machines, printing machines, duplicating machines, folding machines, envelope stuffing machines, etc.

In another, further and more specific respect, the invention relates to improved paper roll feed rack on which a supply of paper may be positioned without the use of auxiliary lift equipment to raise the paper from ground level to position on the feed rack.

In still another aspect, the invention pertains to a paper roll feed rack which, after the paper supply is positioned on the rack for delivery to the paper processing machine, is automatically locked in position to maintain the paper supply in the proper operative position.

The two general types of paper processing machines described in U.S. Pat. Nos. 2,098,427, to Menschner, 3,086,768 to Lach, 3,352,553 to Preston and 3,711,085 to Bunch, Jr. have achieved fairly wide commercial acceptance in the market. These "continuous belt" and "oscillating chute" paper processing machines include a mechanism for distributing successive lines of weakening formed in a strip of paper in substantially opposite directions, rollers for drawing a strip of paper from a supply thereof and dispensing the paper into the distributing mechanism, mechanisms for creasing paper dispensed by the distributing mechanism, and a conveyor system for receiving the creased paper and transporting the paper away from the machine to the dispensing end of the conveyor while the paper is packed or otherwise processed.

As shown in U.S. Pat. No. 3,352,553 to Preston, the paper dispensed during operation of the paper folding machine is carried by a pair of horizontally disposed arm members which are secured to the frame of the machine. Because the weight and size of the paper supply in Preston makes attempting to manually load the paper on the support members generally impractical, auxiliary lift trucks, jacks or other mechanical devices are normally used to displace the paper supply from ground level to a height at which the supply can be rotatably positioned on the support arm members. Operating and maintaining a lift truck or other auxiliary mechanical device to load paper increases the overhead cost and time consumed in processing paper. This is particularly the case when a series of short runs are made in which only a portion of the paper is consumed during each run. In this case, the necessity of removing each partially used paper supply and then emplacing a new supply of a different grade or type of paper measurably increases processing time and cost.

It would be highly desirable to provide improvements in paper processing machines of the type described which would simplify the positioning of a paper supply on the paper processing machine and would reduce the overall auxiliary manpower and equipment costs associated with processing the paper.

As will be apparent to those skilled in the art, the disadvantages described of prior art continuous form paper processing machines are also present in varying degrees in other types of paper handling machines such as printing machines, duplicating machines, envelope stuffing machines, etc., and improvements in paper positioning and support apparatus in such other types of paper processing machines would be similarly desirable.

Accordingly, it is the principle object of the present invention to provide improved apparatus for positioning and supporting a paper supply.

Another principle object of the invention is to provide improved apparatus of the type described which is usefully employed in a wide variety of paper processing machines.

Another and more specific object of the present invention is to provide an improved continuous form paper processing machine.

Still another object of the invention is to provide an improved continuous form paper processing machine of the type having a mechanism which distributes successive lines of weakening formed in a strip of paper in substantially opposite directions, and having additional mechanisms for creasing the paper along the lines of weakening to produce continuous form stationery.

Yet another object of the invention is to provide improvements in the general type of continuous form paper processing machines described in U.S. Pat. Nos. 2,098,427 to Menschner, 3,086,768 to Lach, 3,352,555 to Preston, 3,711,085 to Bunch, Jr. and 3,912,252 to Stephens.

Still another and further object of the invention is to provide an improved paper support carriage on which a paper supply may be positioned without the use of auxiliary lift equipment to raise the paper from ground level to its position on the support apparatus.

These and other, further and more specific objects and advantages of the invention will be apparent to those skilled in the art from the following detailed description and the drawings. For the purpose of illustrating the invention, the detailed description set forth below and the drawings depict the invention as intended to be employed in a specific type of paper processing machine, i.e., an oscillating chute continuous form paper processing machine. However, as will be apparent to those skilled in the art, the improved paper feed rack apparatus described below as being included in a continuous form paper processing machine will be similarly applicable in any other type of paper processing machine which requires a continuous strip of paper during the operation thereof.

IN THE DRAWINGS

Figure 1:
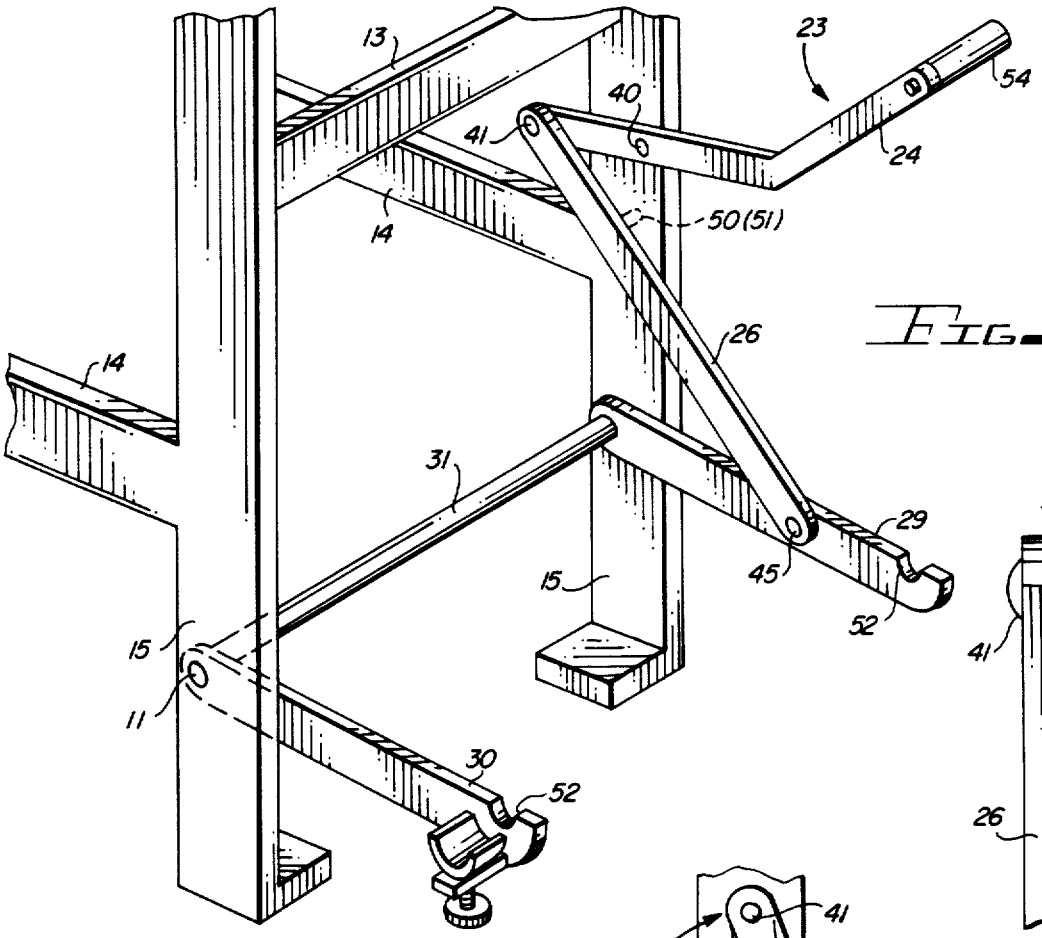
FIG. 1 is a perspective view of an improved continuous form paper processing machine which includes the improved paper feed rack of the invention.

Briefly, in accordance with my invention, I provide an improved apparatus for producing continuous form stationery by creasing a strip of paper along transverse lines of weakening formed therealong. The apparatus includes means mounted on the frame for alternately distributing the successive lines of weakening in the paper in substantially opposite directions, roller means mounted on the frame for drawing paper from a supply thereof and dispensing the paper into the distributing means; means carried by the frame for urging the distributed paper into a creased condition, and means for receiving and transporting the creased paper. The improvement consists of means for removably securing the paper supply in position to dispense paper during operation of the paper folding apparatus. The securing means includes a carriage movably connected to the frame and shaped and dimensioned to receive and support the paper supply; linkage means connected to the carriage and the frame for moving the carriage between at least two operative positions, a first operative position with the paper supply positioned on and supported by the carriage, and a second operative position with the paper supply positioned with respect to the carriage such that the carriage receives and supports the paper supply when the carriage is moved to the first operative position; and means operatively associated with the linkage means for actuating the linkage means to displace said carriage from the first to the second operative position.

Turning now to the drawings which depict the presently preferred embodiment of the invention for the purpose of illustrating the practice thereof and not by way of limitation of the scope of the invention and in which corresponding reference characters identify like elements throughout the several views, FIGS. 1–4 illustrate the presently preferred embodiment 23 of the invention carried on the frame of a continuous form paper processing machine. The frame includes horizontal members 13, 14 and vertical members 15. The frame also supports a plurality of operative elements which receive and crease paper strip from a supply roll carried by rack 23. In a "chute" paper processing machine the operative elements include rollers which draw paper from a supply roll carried by rack 23 and then dispense the paper into an oscillating chute. The chute alternately distributes transverse lines of weakening in the paper in substantially opposite directions. Paper distributed by the chute is creased by "beaters" and "spirals" and is received by a conveyor table which transports creased paper away from the chute and its associated creasing elements.

Bushings in vertical legs 15 pivotally carry the journals of rod 31 of paper roll feed rack 23. Parallelably opposed arms 29, 30 are fixedly connected to rod 31. Semicircular grooves 52 in arms 29, 30 rotatably receive the ends of a spindle of a paper roll which is of the general type shown in FIG. 1 of U.S. Pat. No. 3,352,553 to Preston. Arm 24 is pivotally connected to leg 15 at point 40. One end of arm 24 includes handle 54 while the other end is pivotally connected to link 26 by pin 41. Pin 45 pivotally connects the lower end of link 26 to arm 29.

Figure 2:
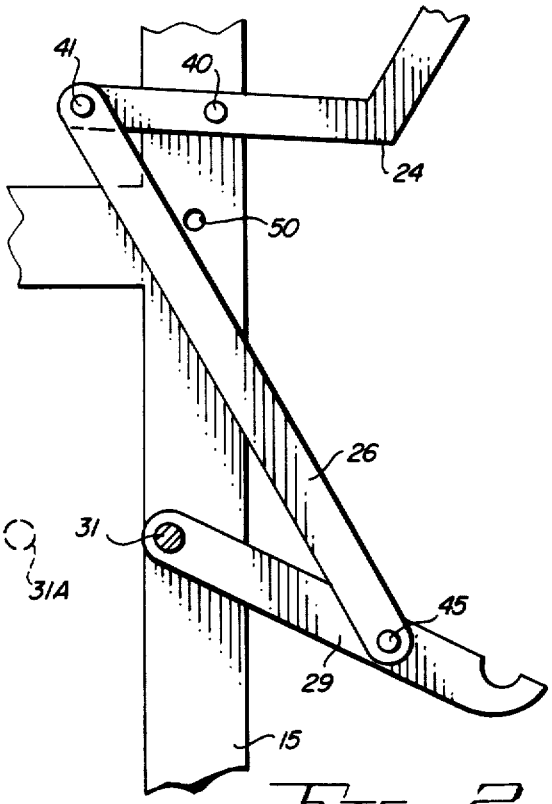
FIG. 2 is a side view of a portion of the paper feed rack of FIG. 1, further illustrating details of the improved paper feed rack of the invention.

In operation, when links 24, 26 and arms 29, 30 are in the positions shown in FIGS. 1 and 2, a paper roll is rolled into position between arms 29, 30 such that the ends of the spindle carrying the paper roll are positioned directly above grooves 52. Handle 54 is then manually grasped and downwardly displaced in the direction of arrow A, arms 29, 30 are displaced upwardly in the direction of arrow B such that grooves 29, 30 engage the ends of the spindle carrying the paper roll and lift the paper roll from the ground. Consequently, when feed rack 23 is in the position shown in FIG. 3, the spindle and paper roll are rotatably supported by arms 29, 30.

Linkage members 24, 26 and arms 29, 30 are constructed so that grooves 52 may be lowered and raised through varying distances to accept paper supply rolls of differing diameters.

Figure 4:
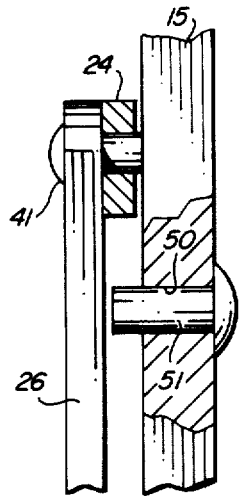
FIG. 4 is a side sectional view of a portion of the improved paper feed rack of FIG. 1.

FIG. 4 is a view from the right hand side of leg 15 shown in FIG. 2 and illustrates pin 51 fitted in aperture 50 in leg 15. The end of pin 51 extends outwardly from leg 15 toward linkage member 26 and stops the downward travel of arm 24 when arm 24 is being displaced in the direction of arrow A in FIG. 3. The distance that the end of pin 51 extends outwardly from arm 15 is such that arm 26 can freely move over pin 51 during the downward and upward displacements of arm 24.

The primary function of pin 51 is to prevent arm 24 from being displaced too far downwardly in the direction of arrow B so that arms 29, 30 begin to again be lowered toward the floor. When arms 29, 30 are carrying a paper roll, arms 29, 30 and 31, link 26 at pin 41 and link 24 at pin 40 support the majority of the weight of the paper roll and there is little resulting torque on arm 24 which tends to force the arm against pin 15.

Figure 3:
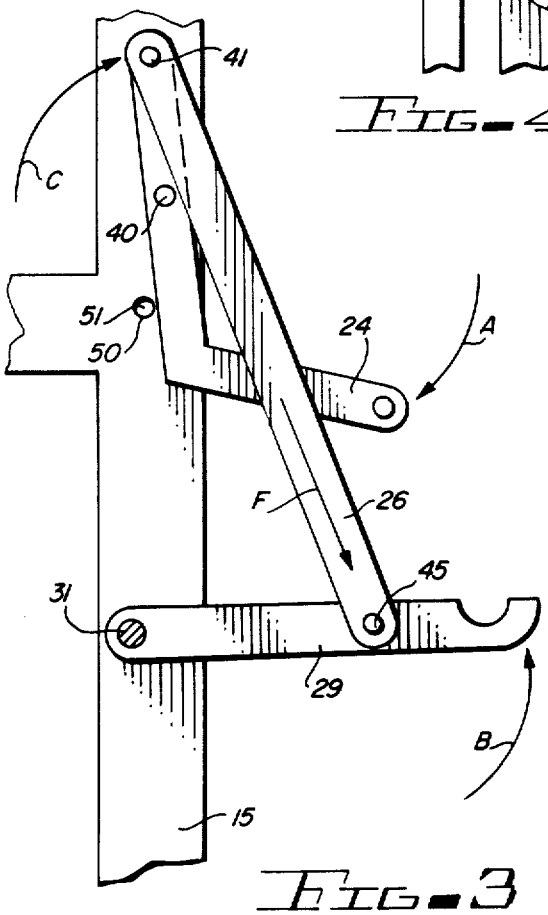
FIG. 3 is a side perspective view of the improved paper feed rack of FIG. 1 illustrating the mode of operation thereof.

The amount by which arm 26 moves "over center" past the upper part of arm 24 is, for purposes of clarity, exaggerated in FIG. 3. In the presently utilized embodiment of the invention, when arms 29, 30 are in the raised position of FIG. 3, link 26 and the upper portion of link 24 are nearly parallel and pins 40, 41, 45 and force F generally lie along a common imaginary straight line. When pins 40, 41 and 45 lie along a common imaginary straight line the amount of torque generated on links 24, 26 is minimized so that after arms 29, 30 are lifted to the position shown in FIG. 3 and are supporting a paper roll, links 24, 26 and arms 29, 30 tend to remain fixed or locked in position after handle 54 is released. Thus, the paper feed rack of the invention automatically locks itself in position after arms 29, 30 have been displaced to their respective positions in FIG. 3 and feed rack 23 will remain in position after handle 54 is released. As noted, links 24, 26 and arm 29 are sized and interconnected so that when handle 54 is displaced in the direction of handle 54, pin 41 is moved in the direction of arrow C slightly "past center" such that the weight of the paper roll causes a small amount of resulting torque to act on arm 24 in the direction of arrow A to force arm 24 against pin 51.

If, as indicated by dashed circle 31A in FIG. 2, axle 31 was moved to the left and connected to another frame member (not shown) of the paper processing machine, then arms 29, 30 would also be moved to the left and, when handle 34 was downwardly displaced as indicated in FIG. 3, link 26 and the upper portion of arm 24 would be parallel and vertical, or nearly vertical. This would further reduce any torque forces on links 24, 26 caused by the paper roll carried by arms 29, 30. However, in practice, the arrangement shown in the drawings has proven satisfactory and is the presently preferred and best mode of the invention.

As would be appreciated, the shape, contour and dimensions of arms 29, 30 and of the linkage system used to displace arms 29, 30 could vary. For instance, more than two links could be used or arms 29, 30 could be attached to a member which slid up and down in vertical grooves formed in legs 15. The principal requirement for the self-locking mechanism of the paper feed rack of the invention is that the linkage system be constructed and attached to at least one of arms 29, 30 (or to the member carrying the arms) such that when arms 29, 30 have been upwardly displaced to lift a paper roll from the floor, any resulting torque on linkage members is minimized and the linkage system tends to —without the application of any additional force to arms 29, 30 or links 24, 26—remain in fixed position after handle 54 is released.

The adjustable paper roll carriage of the invention dispenses with the necessity of utilizing auxiliary equipment for loading and unloading paper supply rolls and facilitates the rapid positioning of paper supply rolls on continuous form paper folding machines during a series of short processing runs.

Having described my invention in such terms as to enable those skilled in the art to understand and practice it, and having identified the presently preferred embodiments thereof, I claim:

1. In combination with apparatus for producing continuous form stationery by creasing a strip of paper along transverse lines of weakening formed therealong, said apparatus a frame, means, mounted on said frame, for alternately distributing said successive lines of weakening in said paper in substantially opposite directions, roller means mounted on said frame for drawing said paper from a supply thereof and dispensing said paper into said distributing means, means carried by said frame for urging said distributed paper into a creased condition, and means for receiving and transporting said creased paper, means for removably securing said paper supply in position to dispense paper during the operation of said paper processing apparatus, said securing means comprising, in combination, (a) a carriage movably connected to said frame and shaped and dimensioned to receive and support said paper supply, (b) linkage means connected to said carriage and said frame for moving said carriage between at least two operative positions, (i) a first operative position with said paper supply positioned on and supported by said carriage, and (ii) a second operative position with said paper supply positioned with respect to said carriage such that said carriage receives and supports said paper supply roll when said carriage is moved to said first operative position, and (c) means operatively associated with said linkage means for actuating said linkage means to displace said carriage from said first to said second operative position.

* * * * *